US007699701B2

(12) United States Patent
Corbo

(10) Patent No.: US 7,699,701 B2
(45) Date of Patent: Apr. 20, 2010

(54) METHOD AND SYSTEM FOR PROVIDING REAL TIME SPORTS BETTING INFORMATION

(75) Inventor: Dana Corbo, Las Vegas, NV (US)

(73) Assignee: DBS Limited Partnership, Vancouver, British Columbia ( * ) Notice: Subject to any disclaimer, the term of this patent is extended or adjusted under 35 U.S.C. 154(b) by 451 days.

(21) Appl. No.: 09/899,711

(22) Filed: Jul. 5, 2001

(65) Prior Publication Data

US 2003/0008711 A1 Jan. 9, 2003

(51) Int. Cl.
*A63F 9/24* (2006.01)

(52) U.S. Cl. ..... 463/25

(58) Field of Classification Search ..... 463/25, 463/42

See application file for complete search history.

(56) References Cited

U.S. PATENT DOCUMENTS 3,648,270 A 3/1972 Metz et al.
4,531,187 A 7/1985 Uhland
4,554,418 A * 11/1985 Toy ..... 340/825.27
4,775,937 A 10/1988 Bell
5,564,977 A 10/1996 Algie
5,613,912 A * 3/1997 Slater ..... 235/380
5,672,106 A 9/1997 Orford et al.
5,713,793 A * 2/1998 Holte ..... 463/1
5,749,785 A 5/1998 Rossides
5,795,226 A 8/1998 Yi
5,801,675 A 9/1998 Paley et al.
5,830,068 A * 11/1998 Brenner et al. ..... 463/42
5,893,091 A * 4/1999 Hunt et al. ..... 707/10
5,984,779 A 11/1999 Bridgeman et al.
5,999,808 A * 12/1999 LaDue ..... 235/380
6,033,308 A 3/2000 Orford et al.
6,067,068 A 5/2000 Hussain
6,099,409 A 8/2000 Brenner et al.
6,174,233 B1 1/2001 Sunaga et al.
6,393,437 B1 * 5/2002 Zinda et al. ..... 200/203
6,741,980 B1 * 5/2004 Langseth et al. ..... 707/2

OTHER PUBLICATIONS

Don Best Sports web page, http://www.donbest.com.*
Human Factors Design Guide, Federal Aviation Administration, 1996, pp. 8-41, 43, 45, 46, 50, 54-56, 61-63.*

* cited by examiner

*Primary Examiner*—Corbett B Coburn
(74) *Attorney, Agent, or Firm*—DLA Piper LLP US

(57) ABSTRACT

The present invention involves a method and system for providing sports betting information, in real time, utilizing a standard Internet connection on a computer to display the odds from a plurality of sports books. The system provides its users with a line seeker alert, a major line move alert, a bet tracker, and a fully customizable display. A method of gaining real time sports betting information without the use of a web browser, through the use of a separate program written in the C++ programming language is disclosed.

25 Claims, 6 Drawing Sheets

METHOD AND SYSTEM FOR PROVIDING REAL TIME SPORTS BETTING INFORMATION

THE FIELD OF THE INVENTION

The present invention is directed toward gaining information regarding sports betting. Specifically, the present invention gains betting information, in real time, from major Las Vegas and international sports books, which are the mediums that take and cover bets on various sports. The improvements include a line seeker used to alert the user of a predetermined line, a major line move alert used to alert the user of a "major line move" between the various sports books, a bet tracker which keeps a log of each bet made by the user, and other fully customizable features to make the program more user friendly.

BACKGROUND OF THE INVENTION

The business of sports gambling is a multi-billion dollar industry, especially in places, like Las Vegas and outside the United States, where it is legal. With the size of the industry comes the need for information, such as the current odds regarding the event to be bet on. Odds are used in order to balance the amount of money bet on each team, so as to protect the individual or establishment taking the bet from losing money. For example, games where there is a powerful team taking on a weaker team would obviously generate more bets for the more powerful team. Odds are introduced to deter some of those who would place bets on the powerful team. These odds can be in the form of a point spread (or line), which force the "favored" team to win by a certain amount of points or the "underdog" to lose by less than those points, in order for someone betting on them to collect. These odds fluctuate as bets are taken, so the total amount of money bet on one team is the same or very close to the same as on the other team. Each sports book, which takes bets, can therefore have different odds, depending on what bets they have already taken. For a prospective bettor, the current odds for each sports book are important because they may want to bet on a game at certain odds. Therefore, there is a need for real time odds information for the various Las Vegas and other international sports books.

Typically, in order to become aware of the lines/odds of a sports book, one must contact each sports book and inquire as to the odds. By the time one has contacted all of the sports books and decided on one to place a bet with, the line/odds may have changed. The present invention addresses this issue by allowing one to check all odds/lines, for each sports book, on-line, in real time. The present invention allows for the user to set predetermined lines he wants to bet on, alerts the user of major line movement between the sports books, keeps a record of the user's betting history, and allows for full customization of the display.

The first prior art is the old Don Best Sports program, DBS. This program is written in Java and accessed via the Don Best website on the World Wide Web, at www.donbest.com. The DBS Java program displays odds and lines from major Las Vegas and International sports books in real time, along with other sports gaming information. FIG. 1 shows a typical view of the DBS program, as would be viewed by the user. The new Internet program is written in the C++ programming language. It includes a line seeker feature, a major line move alert, a bet tracker, and other features that allow for customization of the display. These improvements allow for the original DBS program to be both more user friendly and practical in the acquisition of information.

U.S. Pat. No. 5,564,977 to Algie teaches an apparatus for a betting parlor associated with a racetrack or totalizator company, including a display of a large amount of racing and parimutuel data, particularly periodic parimutuel or odds data and the history thereof. Racetracks or "off-track" betting parlors, in order to stimulate betting by its patrons, mainly use this prior art. It amounts to a scoreboard that relays information regarding horse racing, including real time odds for the races running at the particular track. The present invention differs from this prior art in that it allows for the real time odds for various sports over the Internet. The present invention also allows for the user to interact with the system through the line seeker, major line move alert, bet tracker, and customizable display features.

U.S. Pat. No. 6,099,409 to Brenner describes systems and processes for interactive off-track wagering. Odds, pools and payoff amounts can be viewed for a variety of complex wager types. The waging system uses totalizators to generate waging odds in real time based on the wagers. A user terminal alerts a user that a race is a bout to be run or a waging transaction is being sent. This system allows a user to get odds on, place bets on, and view horse races on one terminal. The present invention does not allow the user to place bets or watch races. The present invention provides the user with odds, for various sporting events, from several different casinos/sports books. The present invention comprises features that allow the user to customize the display of the odds and enter parameters for odds he is seeking.

The discussed prior art presents a database of information. However, this prior art does not attempt to solve the problems that the present invention is designed to answer. The present invention comprises new features to an on-line real time odds acquisition program. These features allow the user to customize the display of the odds and enter parameters for odds he is seeking.

It should be clear to one skilled in the art, that the above discussed prior art is used for the purposes of illustration and should not be construed as limiting in any way, except for the prior art elements claimed in the above patents.

SUMMARY OF THE INVENTION

It is an object of the present invention to provide for improvements to an existing odds acquisition program.

Another object of the present invention is to provide for improvements to an existing odds acquisition program comprising a line seeker feature, a major line move alert feature, a bet tracker feature, and other customizable display options.

Another object of the present invention is to provide for improvements to an existing odds acquisition program comprising a line seeker feature, wherein said feature can be programmed to alert the user when certain predetermined lines have become available.

Another object of the present invention is to provide for improvements to an existing odds acquisition program comprising a major line move alert feature, wherein said feature can be programmed to alert the user when a certain number of sports books move a line a certain amount, within a certain time.

Another object of the present invention is to provide for improvements to an existing odds acquisition program comprising a bet tracker feature, wherein said feature allows users to log each bet made to provide a running list, then automatically grades the bets by incorporating scores into the system, telling the user how much he has won or lost.

Another object of the present invention is to provide for improvements to an existing odds acquisition program comprising customizable display options, wherein said options include moveable casino columns, resizable casino columns, columns that can be highlighted, shaded, and zoomed, automatic and manual scrolling pages, color coded changes, and an informational column that shows injuries, weather, lineups and urgent information.

Other objects of the present invention will become apparent from the foregoing description. It should be understood by one skilled in the art that the terms and identifications used by the applicant should not be interpreted as limiting the invention to a particular embodiment or object described above. Only the prior described above contains possible limitations to the present invention.

BRIEF DESCRIPTION OF THE DRAWINGS

The following description of preferred embodiment of the present invention will be better understood when read in conjunction with the appended drawings. It should be understood, however, that the invention is not limited to the precise arrangements shown in which.

DETAILED DESCRIPTION OF THE DRAWINGS AND THE INVENTION

Figure 1:
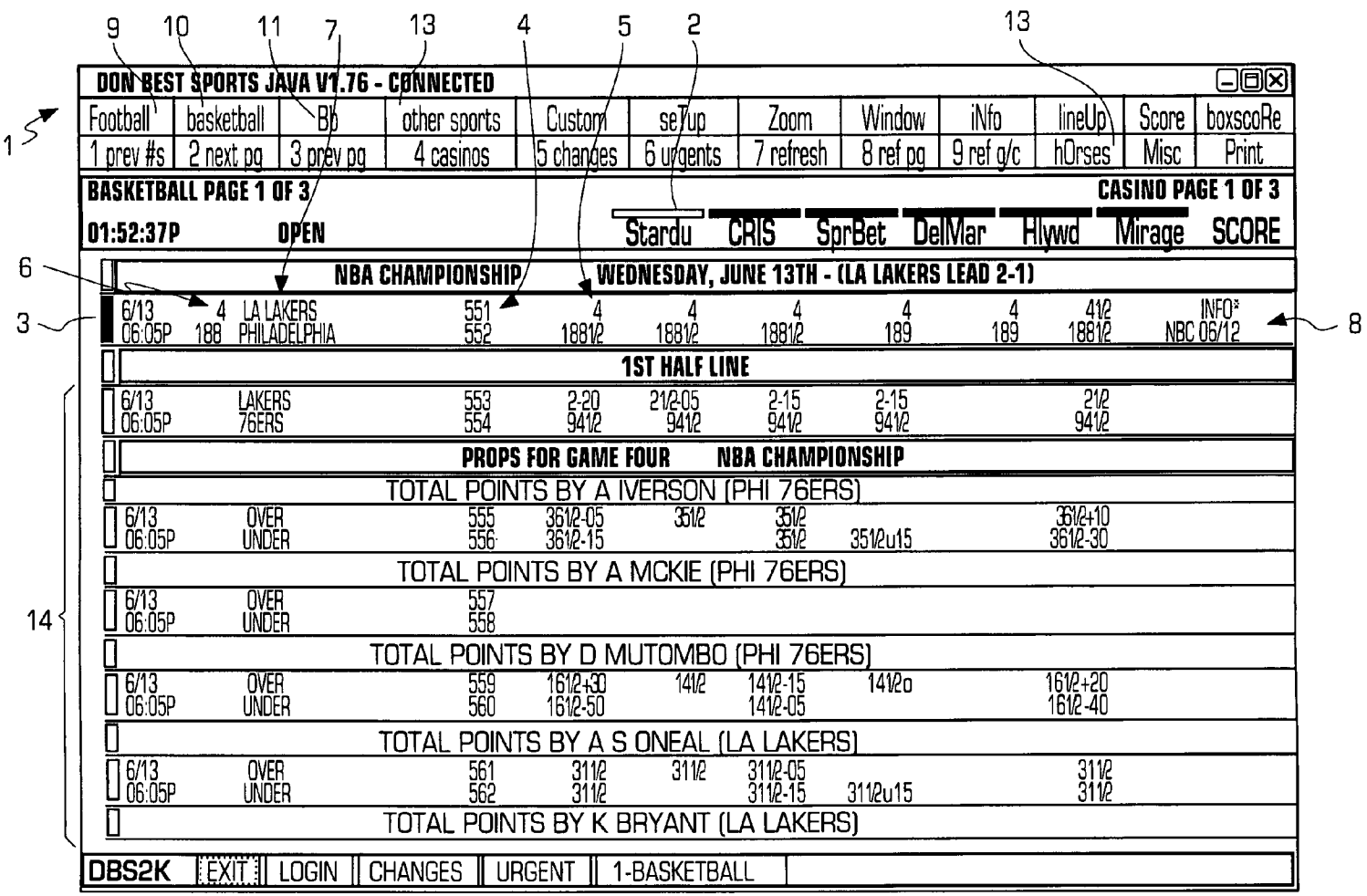
FIG. 1 is a screen shot of the DBS Java program v1.76 as would be viewed by the typical user.

The present method and system is applicable to the field of sports betting. For every sporting event, there are various odds, lines, and types of bets that can be made. For every bet, there are various sports books that the bet can be placed through. Knowing these sports books and their corresponding odds is sometimes the most important piece of information a prospective bettor needs in order to come out victorious. However, up until now the acquisition of this information was accomplished either through the tedious process of contacting the various sports books or by reading published odds that may not be up to date. In both cases, by the time it was time to place the bet, the information may have been outdated. For both the serious and occasional bettor, an easier and more accurate way of acquiring this information was needed.

With the dawn of the Internet age came the advent of real time information. The Internet makes it possible to get up to the minute news, which includes up to the minute sports gambling information. The present invention does just that. A user is given real time information regarding the odds/lines on various sporting events, from every major casino/sports book. The present invention provides a medium for searching and gaining odds for whatever event a user desires. Any and all pertinent information regarding a given sporting event or events can be gained using the present invention, which in turn allows the user to make more intelligent decisions regarding his bet.

The present invention consists of a computer program that is written in the C++ programming language. The program works without the use of a web browser and can be held on standard memory storage device, such as a floppy disc or a CD-Rom. The program, once installed on a computer, works in conjunction with an Internet connection, in order to provide the user with information regarding sports gambling. Specifically, the program provides the user with a schedule of all sporting events for the given time period, and the different bets that can be made on each game. These events and bets each have their own corresponding odds, which are given to the user for all of the different sports books that a bet can be placed at. A user who correctly utilizes the information will look for the sports book with odds most beneficial to the bet he wants to place. These odds are given to the user through a display, which organizes them into rows and columns. The game and bet information are listed in the horizontal row, while the sports book odds are broken up into the vertical column. This allows the user to cycle through odds for the different sports books for one particular game or bet. The present invention does not allow the user to place bets, it only provides the user with a medium to gain the information he needs to make a decision on what game and on what team to place a bet.

The present invention, utilizing an Internet connection, provides the user with a display consisting of pertinent odds information. The user can navigate through this display, with the use of various menus, in order to display the information desired. For example, if the user wants to get information regarding basketball, he will click on the corresponding button (Bball) using a standard computer mouse. Separate windows, within the program, can also be brought up to exhibit other information regarding a given game or sport. For example, if a specific game has injury information, a cell in the game row and the info column will display a message. The user can then click on this column to bring up a separate window that dictates the injuries and probability of the player playing in the game. The user operates the menus and selects other options through the use of a mouse and or keyboard type input device.

The invention provides the user with a medium to gain the sports betting information, in real time. Along with the above described display options, the present invention also alerts the user when a predetermined occurrence takes place in connection with the odds. These alerts include one for a predetermined line becoming available and another for a "major line move" between the various sports books and casinos. These new features allow the user to gain information without having to search or constantly watch the odds as they change. For example, if the user wishes to place a bet at specific odds, he can set the line seeker alert, and that will notify him when any sports book offers those particular odds. The major line move alert can be set to notify the user if a predetermined amount of sports books change their lines, on a specific game, within a predetermined amount of time.

The invention also provides the user with a means to log and track bets for a complete total of winnings and losses. This bet tracker feature, as it is called, allows the user to log each and every bet he makes into the system, which in turn calculates and lists a total of winnings and losses. This allows the user to keep track of his betting without the use of outside mediums, such as notebooks and diaries.

The display features of the present invention can be manipulated to fit the user's preference, allowing the user to more efficiently utilize the program and its features. This makes the program more useful for a greater audience. Different bettors want different odds and sports books. The present invention takes the standard display of the prior art and allows the user to dictate what information he wants it to display. For example, the user may consistently bet at five or six sports books that he wants displayed at all time. With the new display options, the user can move, resize, and zoom columns to display the sports books in a way more conducive to his betting style. This and the above features constitute improvements to an already existing odds acquisition program, accessible via the Internet.

For the following description, game four of the 2001 NBA Finals, between the Los Angeles Lakers and the Philadelphia 76ers, and the odds reflecting those of the Stardust Casino were used.

Figure 2:
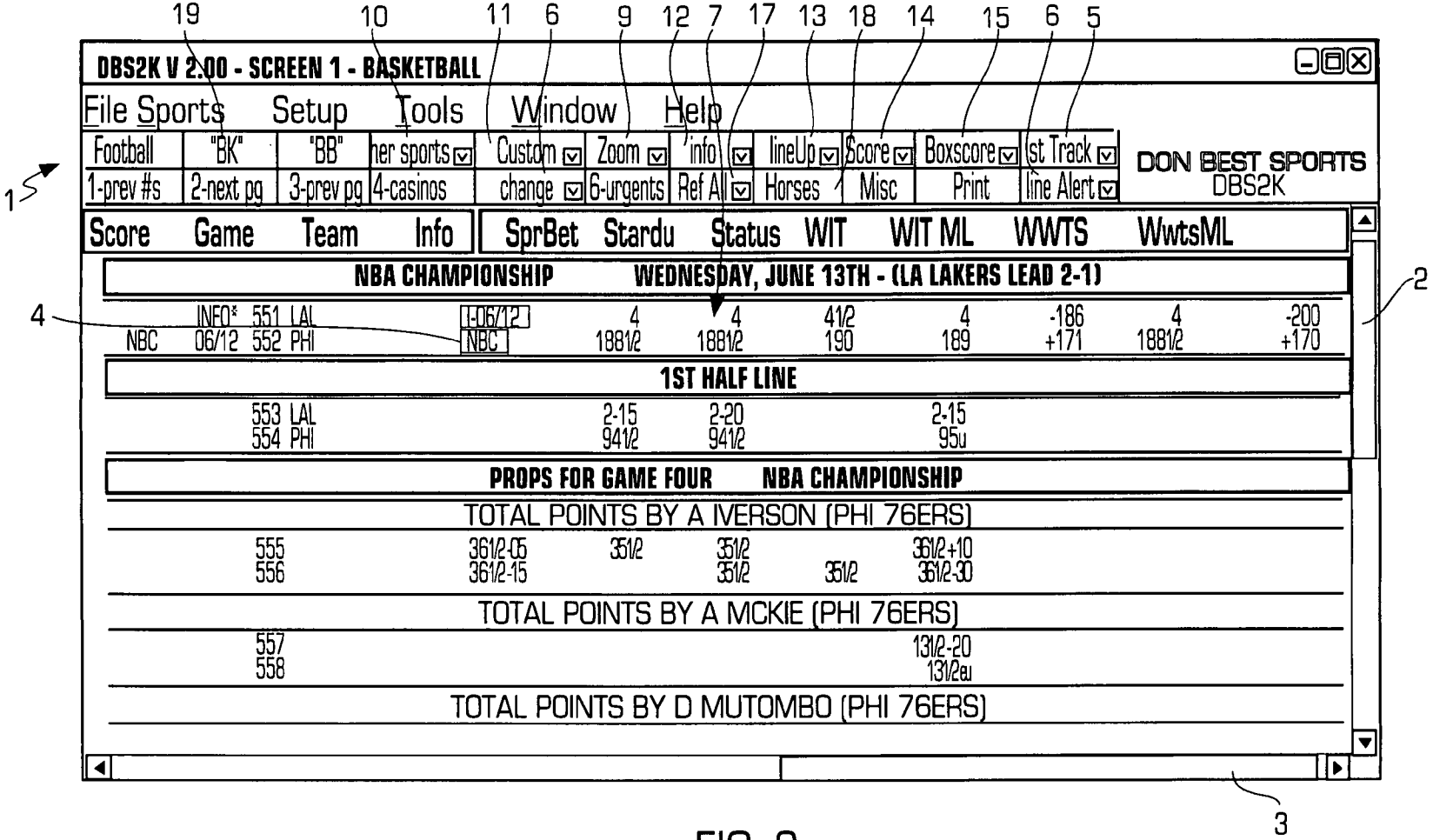
FIG. 2 is a screen shot of the DBS2K C++ program v2.00 (The present invention) as would be viewed by the typical user.
Figure 6:
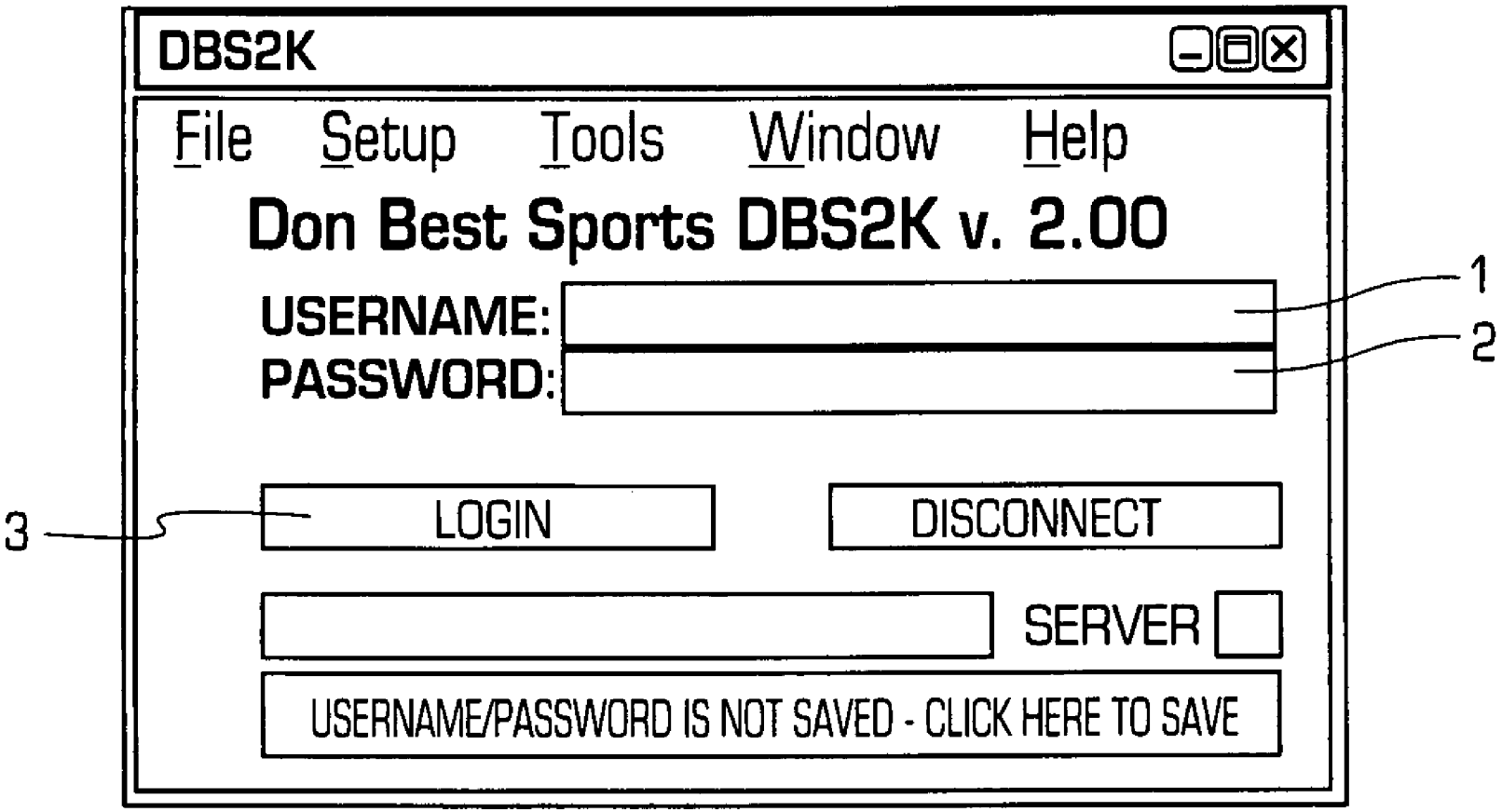
FIG. 6 is a screen shot of the Login screen, which allows the user to access the system only when a valid username and password is entered.

The present invention is available to a user through the use of a computer and a standard Internet connection. An Internet connection can consist of any type, such as a dial-up, cable, and DSL connection. The user first needs to acquire a copy of software, which can be held on a disk or downloaded, and install it on his computer. Preferably, the user can obtain the software from the provider after subscribing. Once the software is installed on the user's computer, a connection to the Internet is established, and the program is loaded, the login screen loads, as shown in FIG. 6. This security feature requires the user to subscribe to the system in order to gain access. The user must register and pay whatever fees are required in return for a valid username and password. In order to login to the system, the user must first establish an Internet connection. The user then enters his username in field 1 and the corresponding password in field 2. Once this is complete, the login button 3 is pushed and the user is logged into the system. A successful login will allow the user access to the various features of the program. The user will first be brought to the initial odds screen as shown in FIG. 2.

FIG. 1 shows a screen shot of the DBS Java based prior art program. This represents the most relevant prior art. This program is accessed via the Don Best website, and is navigated through your web browser. The program is brought up through a series of web browser windows, which requires that multiple windows, of the web browser, be open at one time. The program can only be accessed after a valid username and password are entered on the initial login page.

The menu 1 at the top of the screen is used to perform the various operations within the program. From this menu, the various sports can be selected, the pages can be cycled as to show more information, the casinos can be selected, the view can be changed, and other information such as lineups, injury/weather info, and scores can be attained. The menu has three buttons that correspond to football 9, basketball 10, and baseball 11. All other sports can be accessed using the other sports button 12 and horseracing odds can be accessed via the horses button 13.

The view works as a grid system, where the column selected can be seen in the column box 2, and the row selected can be seen in the row box 3. This row and column combination corresponds to the game and casino you are interested in. From this point, the various operations are performed for that selection. In FIG. 1, the game selected is the Wednesday, Jun. 13, 2001 NBA Championship, between the Los Angeles Lakers and the Philadelphia 76ers. The sports book selected is that of the Stardust casino. The row 3 first discloses the time (Western Standard Time) and date of the corresponding game. The row 3 then lists the opening lines 6 which correspond to the original point spread and the over/under. (over/under odds refer to the total number of points scored between the two teams). The row 3 then gives the team names 7 and the corresponding game numbers 4 used in placing bets. The row 3 then begins the column portion 2 of the display, where each sports book's odds are listed. Finally, the row 3 ends the display with a score/info column 8, where relevant information regarding the game, and any scores relating to the game are listed. The DBS Java v1.76 only allows for the odds of a set number of casinos to be viewed at one time, as well as a set number of bets. The other bets shown 14 represent the different types of bets that can be placed including, over/under, individual player bets, and 1$^{st}$ half bets. The display also does not allow the user to manually scroll down to other games within the sport. The menu 1 options regarding pages, labeled 2 and 3 on the menu, are the only way to move between pages and view different games.

FIG. 2 shows a screen shot of the present invention, DBS2K v2.00. This program is based in the C++ programming language, and is accessed from your desktop without accessing a specific website. However, a standard Internet connection is necessary for the program to access the odds/betting information. Referring to FIG. 2, the menu 1 has a number of changes from that of menu 1 in FIG. 1. Namely, buttons 5 and 6, corresponding to the Bet Tracker and Line Alert respectively have been added. In addition to those buttons, several other buttons have been equipped with pull down menus allowing for more customization of the tasks the user wants to perform. For example, the pull down menu for the zoom button 9 allows for different columns to be zoomed in for better viewing. The user simply clicks on the downward arrow to display the pull down menu, and chooses which columns he wants zoomed. In FIG. 2, the Team column, where abbreviations instead of full team names are seen, has been zoomed so that more sports books can be viewed without having to scroll horizontally.

Several other buttons have their own corresponding pull down menus. The pull down menu for the other sport button 10 allows the user to choose those other sports that do not have their own corresponding buttons, like football, basketball, and baseball do. These sports include: hockey, soccer, boxing, golf, tennis, and auto racing. There are also options to choose the line seeker feature, major line move feature, and change the window. The pull down menu for custom 11 allows the user to make changes to the display and setup. The user can choose to select a display of all of the games available on the system, set the auto scroll feature to turn the page every five seconds, enter the custom setup screen where the user can set his preferences for what is displayed, and enter the custom display screen which allows the user to modify the display. The pull down menus for info 12, lineup 13, score 14, and box score 15 all allow the user to get pertinent information regarding the selected game, selected sport, all games, or archives. This is useful for the user that wants all of the information available for a bet or series of bets. Finally, the pull down menu for the change button 16 allows the user to list all of the recent changes in odds. These changes can be listed in list form or in a new window.

Along with the menu changes, FIG. 1 also shows some other display changes. In the present invention, not only can the display be vertically scrolled using the menu buttons, it can also be scrolled manually using the vertical scroll bar 2 on the right side of the screen. In addition, the casino columns can now be scrolled, using the horizontal scroll bar 3 on the bottom of the screen, allowing the user to view any number of sports books and their corresponding odds. This gives the user the option to view all sports books without having to setup a different display, as was the case in the prior art. Instead of the row and column markers utilized in the prior art, and seen in FIG. 1, the selected game and sports book is represents by a shaded cell 7. This allows the user to easily recognize which game and casino he has selected.

The pull down menu for the Line Alert button 6 (FIG. 2) allows the user to select between the Line Seeker and Major Line Move Alert features. Both of these features provide the user with an alert when a predetermined occurrence takes place in connection with the odds. For the line seeker feature, the user can bring up the corresponding input form (FIG. 3) and casino setup, as well as a window containing all lines that are being sought by the user. For the major line move feature, the user can bring up the corresponding setup form (FIG. 4), as well as a window containing all of the major line moves the system has detected for a given period of time.

Figure 3:
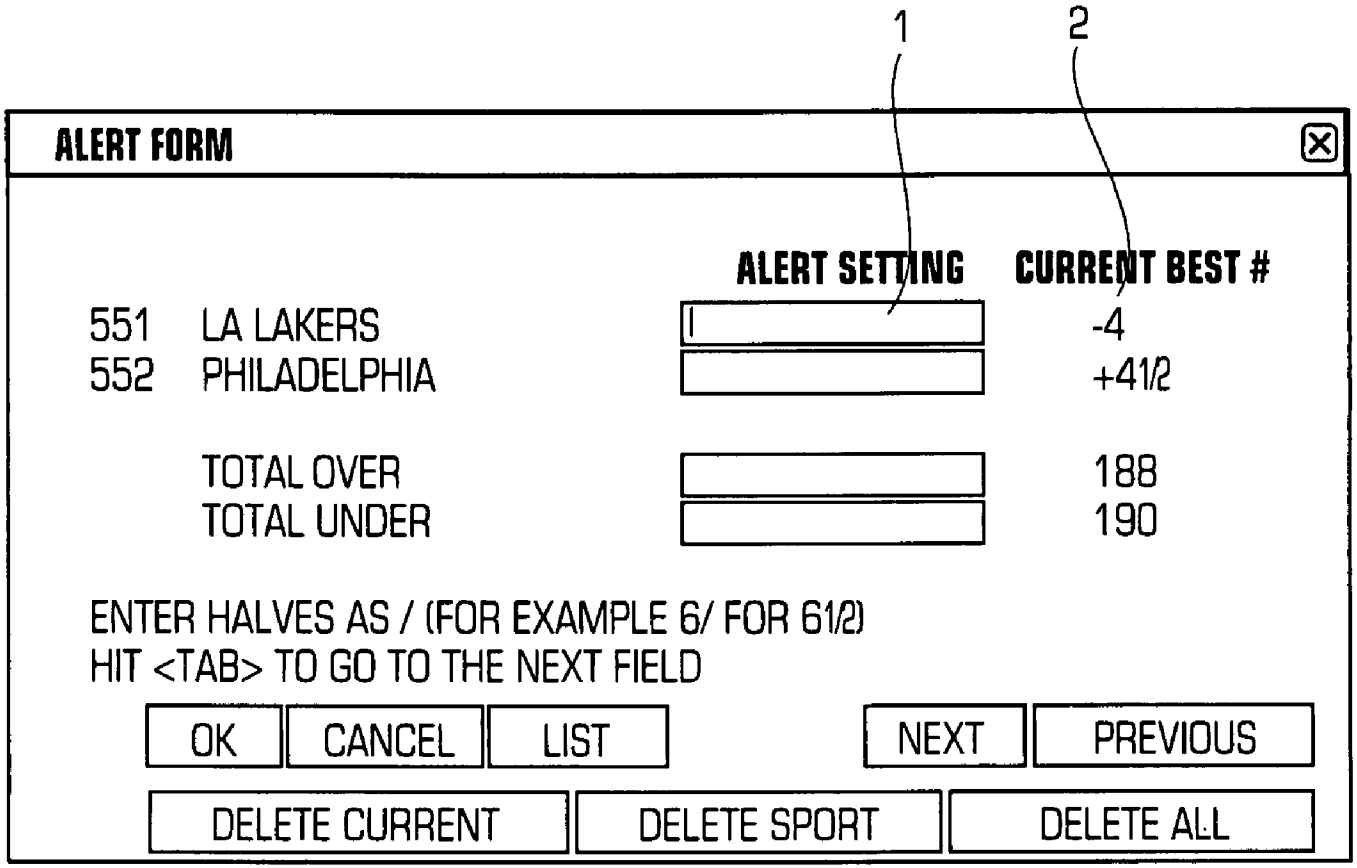
FIG. 3 is a screen shot of the Line Seeker input form used to predetermine a line the user would like to be notified about.

Referring to FIG. 3, the Line Seeker input form can be seen. This form is shown to correspond to the game disclosed above. The "Alert Setting" column 1 contains fields for the user to enter predetermined lines that he would like to bet at. The "Current Best #" column 2 gives the best line as it stands at the time the form is brought up. These columns are used in conjunction with one another to set an alert for the user. For example, if the user wishes to bet on the Lakers, but feels that the current best line of −4 represents too many points to give, he can enter a value that gives less points, say −3, and he will be alerted when any sports book offers a line equal to or less than his setting. This is very important for a bettor who knows the odds he is willing to bet on, but does not have the time to stare at a computer screen and search for the best line. When the specific line is offered by a given sports book, the user is given both an audible and visual notification.

Figure 4:
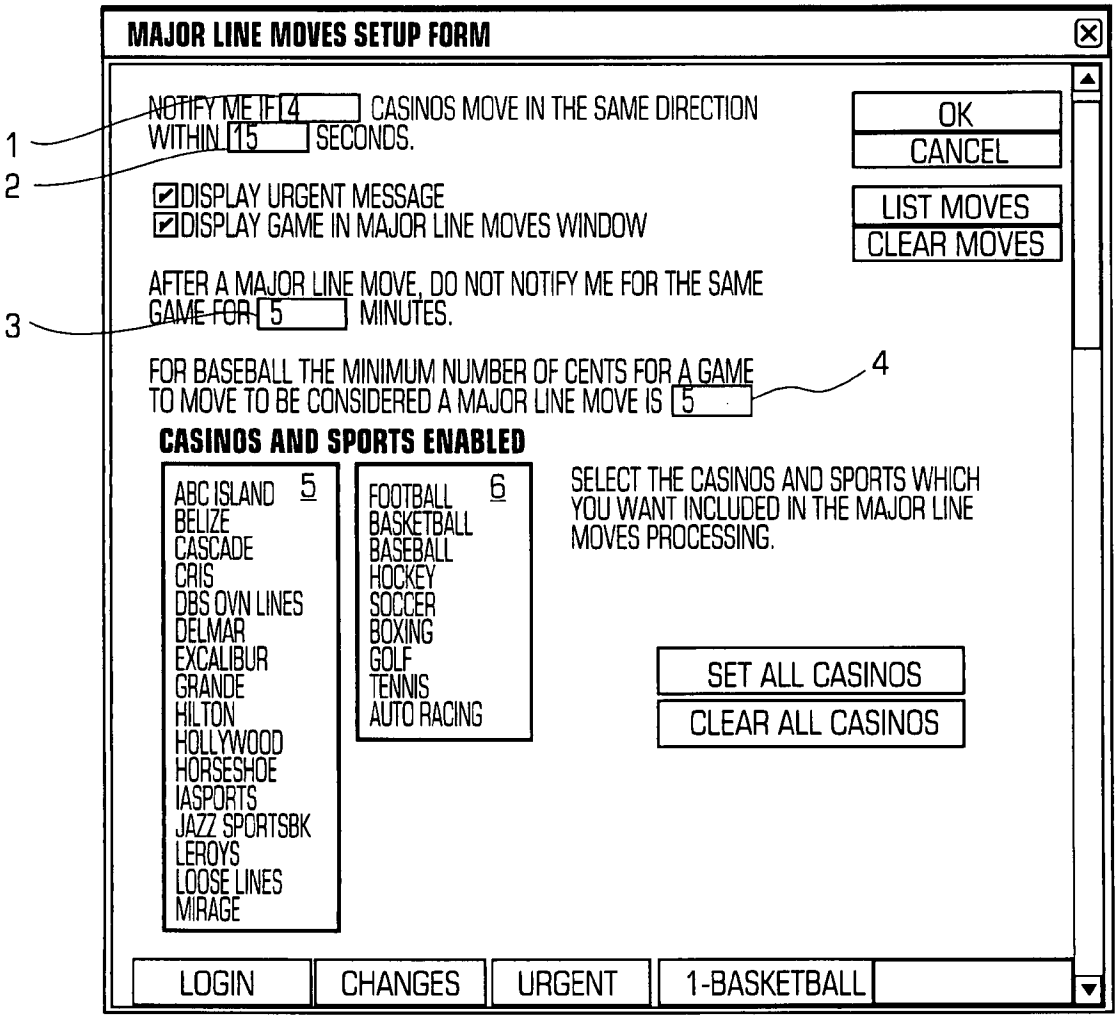
FIG. 4 is a screen shot of the Major Line Moves setup form, which allows the user to set, parameters for which to be notified regarding line changes between various sports books.

Referring to FIG. 4, the Major Line Moves setup form is shown. This form allows the user to specify parameters that need to be met in order for the present invention to issue a "Major Line Move alert." This alert is issued when a given number of sports books move their lines in the same direction within a given amount of time. This is important for the user who wants to know where and when major "action" occurs. For example, if some information regarding a game comes into light, a line may move in one direction or another. A seasoned bettor may want to bet on a line before it completely moves away from its present level. In FIG. 4, field 1 represents the number of casinos/sports books that must move in order for the alert to be issued, field 2 represents the amount of time that can elapse between each move in order for the alert to be issued, field 3 gives the time the user does not want alerts after given an initial alert on a specific game, and field 4 gives the amount of cents a line must move in a baseball bet, in order to consider it a major line move. Columns 5 and 6 allow the user to specify which sports books and sports should be monitored in conjunction with the major line move alert. Once again, the alert is given both audibly and visually.

The pull down menu for the bet tracker button 5 (FIG. 2) allows the user to access the Bet Tracker feature. This feature provides the user with a means to log and track bets for a complete total of winnings and losses. The user can bring up the bet tracker input form (FIG. 5), display a report of current bets, grade all outstanding bets, and display an archive of all previously made bets.

Figure 5:
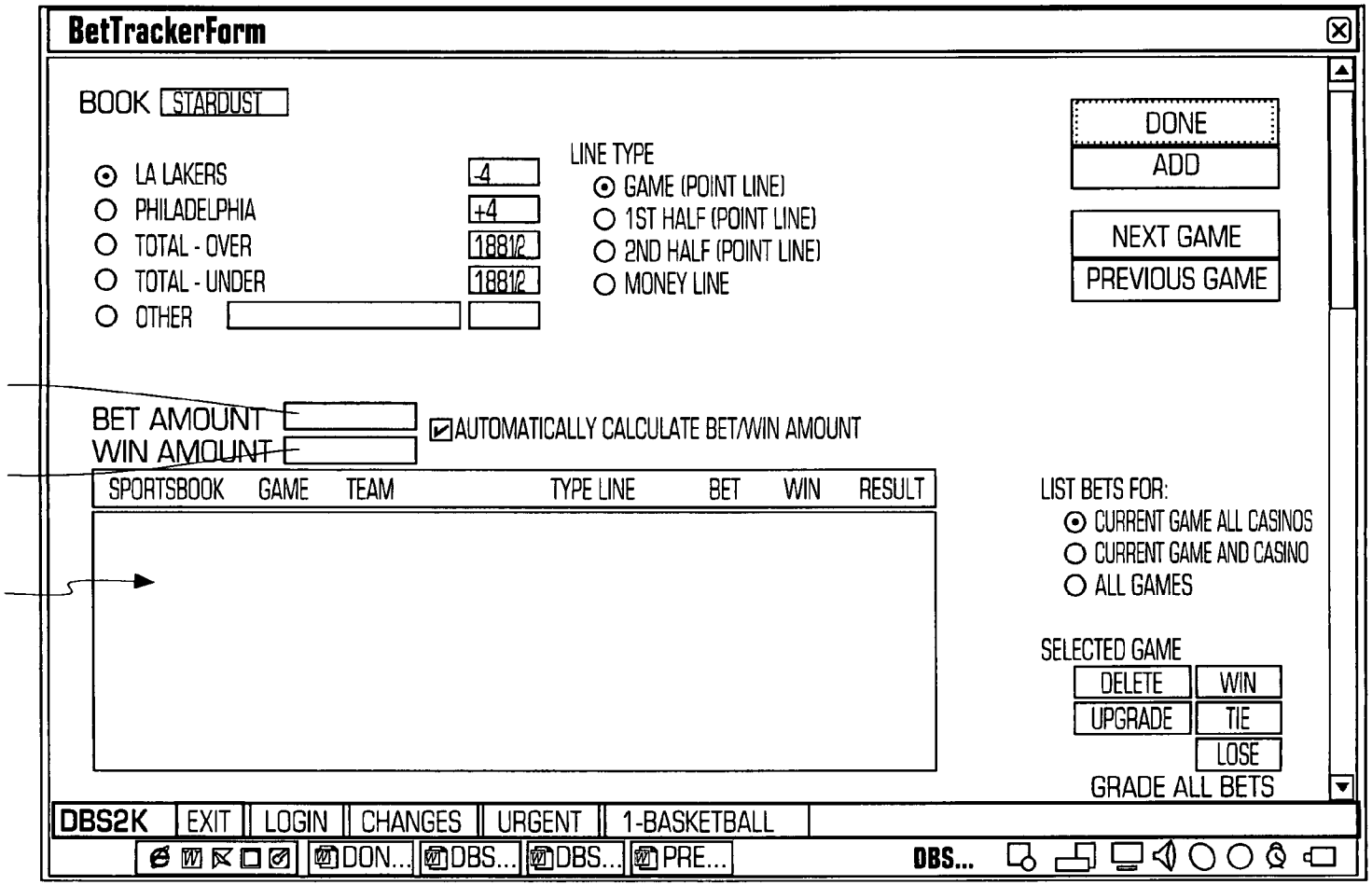
FIG. 5 is a screen shot of the Bet Tracker form that allows the user to log each bet he makes, in order to keep a running total of money won or lost.

Referring to FIG. 5, the Bet Tracker form is shown. The filled out portions of the form correspond to the game and sports book that was selected on the display screen, as shown in FIG. 2. The user, for whatever bet he has placed, can select the teams and line type. In this situation, the Lakers need to win by four or more points in order for the bet to be won, at the Stardust casino. Once this is selected, the bet amount must be entered in field 1. The system then calculates, unless unselected, the win amount for the given bet. This bet is then added to the list of bets listed in field 3, by clicking the "Add" button 4 on the top right portion of the form. This feature allows the user to keep a record of all the bets he has made, and their outcomes. This can prove to be a very useful tool for the serious bettor who makes many bets per week and does not keep accurate records on his own. This feature is accessible whenever the user is logged onto the system, and is updated each time the user chooses to grade the bets. Grading simply takes the results of the given game and applies them to the bet, giving the user either a win, loss, or push/tie.

The invention can be customized in several different ways. Besides the display features that were disclosed above, the display could be shaded and color-coded for easier viewing. Each column can be moved, resized, and highlighted. This allows the user to customize what the display looks like and what odds it contains. The pages can also be automatically scrolled using the "Auto Scroll" feature. This feature turns the page every five seconds allowing the user to view various sports and their odds without performing any command. Finally, the present invention offers an "Info Column" that brings up relevant injuries, weather, lineups, and other urgent information, in another window. This information corresponds to the selected game and/or all games for a given sport.

The following gives a description of a typical session for a user:

A bettor may wish to place one or several bets on a given day. Before doing so, he would need to know what games there are, the odds of those games, and any pertinent information that could help him make an intelligent decision regarding the teams involved (e.g. lineups, injuries, win/loss records, etc . . . ). The present invention can provide the user with all of this information, but first the user would have to establish a connection with his Internet service. In this example, we will use a dial up Internet service. Therefore, the user would have to use a modem to connect with this service through a standard phone line. In a typical example, the user would have to load a program used to gain access. The user may have to enter a valid username and password, so as to verify to his provider that he is a current customer. Typically, the program would then establish the connection needed to access the Internet.

Once the Internet connection is established, the program that constitutes the present invention can be loaded by simply double clicking on a standard desktop icon. (This icon appears on the user's desktop after the initial installation of the program). After the program loads, the login screen (FIG. 6) appears. Here the user enters a valid username and password to gain access to the system. This security feature allows the system to distinguish between valid registered customers and those who are not. After those fields are entered, the user clicks on the login button. This begins the system login procedure, which ultimately results in the user being brought to the odds screen, as shown in FIG. 2.

After the above procedure is completed, and the user is admitted into the system, he can begin utilizing the odds acquisition features of the program. This is achieved with the above described menu options. Utilizing the menu, the user can navigate through the system's various options for acquiring the data desired. Several buttons on the menu have pull down menus, which amount to options within the category. These pull down menus are accessed by clicking on the downward arrow to the right of the button. From there, the option can be chosen by once again clicking on that option. For our example the user wishes to gain information regarding game four of the 2001 NBA Championship. Therefore, once logged onto the system, the user would select the BK button 19 (FIG. 2) corresponding to basketball. This would bring him to the screen shown in FIG. 2. There, the user can view all of the bets that are available for that game. The user can also utilize the info 12 and lineup 13 buttons to bring up additional windows of information regarding the game.

After the user takes an initial view of the odds and information, he may not have found odds that are satisfactory to him for betting. In the example, the user may think that the Lakers will win the game, but not by four points. At this point he can utilize the Line Seeker feature. Using the line alert button 6, the user can enter the line seeker input form, as shown in FIG. 3. Here, he can see that the current best line for the Lakers is −4 (Lakers need to win by four to produce a winner). The user can then enter an amount of points he thinks the Lakers will win by in column 1, say for example −3 (Lakers need to win by three to produce a winner). Now, once this line is available for betting at any one of the sports books, the user will be given an audible and visual alert. The user can set many of these alerts for different games, and view a list of all of the alerts he has set by choosing "line seeker window" from the line alert pull down menu.

The user may also want to monitor the action that occurs within the various sports books. For example, the user may want to be notified when there is a "major line move", or a series of line changes on one game between several sports books. This can put the user on notice of serious betting on one side of a game or the other. Information like this can be useful to the user in deciding which side to bet or whether or not to bet at all. To set a major line move alert, the user can open the pull down menu for the line alert button 6. From there, the user can enter the major line moves setup form, as shown in FIG. 4. The user then enters the information regarding how many casinos must move, the amount of time of the move, the amount of time to not notify the user for the same game, and the minimum number of cents for a baseball game to move in order to be considered a major line move. For our example (FIG. 4), if four casinos move within fifteen seconds, the user will be alerted. Also in the example, the user will not be alerted for the same game until after five minutes has gone by since the last major line move, and a baseball game line must move five cents. Therefore, user will now be notified for any game, in any sport, within the system's database that meets these parameters.

After the user finds a line that he is willing to bet on, whether notified or found through searching, he may place the bet with the corresponding sports book. The invention may not allow the user to place bets, only to research them. In order to place a bet, the user may contact the given sports book. However, the present invention does allow the user to keep a log and a running tab of all bets and the corresponding winnings and losses. To enter this information, the user must first select the game and casino he is betting on. Then he must use the pull down menu of the bet tracker button 5. From there, the user can enter the bet tracker form, as shown in FIG. 5. By selecting the game and casino on the display menu, this information is automatically entered in the bet tracker form. The user then selects which team to bet on, enter the line type, and enter the bet amount. The present invention then automatically calculates the win amount, unless this function is unselected. Once all of this information is entered, the user must push the add button 4 to add this bet to the list of bets he has made prior to this one. Now, the user can display a list of all of his bets or grade his bets using the pull down menu of the bet tracker button. Selecting the grading feature allows the present invention to apply the scores for the game bet on and to calculate whether the user has won or lost. Then the user can keep a running tab of his winnings and losses.

The invention constitutes a better way to research and track wagers on sporting events. Following the above description, a typical user can acquire any information he may need to make a more intelligent bet. All of the information obtained is in real time, so as to make the day of newspaper lines and odds in the past. The added features even make the researching easier and the user better informed. With the help of the present invention, the user can better offset the risk of losing, by being more informed.

Modifications may be made within the scope of the invention, which would include, among others, placing bets on the system when the user so decides.

In the foregoing description of the invention, reference to the drawings, certain terms, have been used for clarity, conciseness and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented, or described.

What is claimed:

1. A method for providing sporting event odds and information, in substantially real time where the sports books, gamblers and enthusiasts want real time odds and information on the sports books computer, the method comprising:

providing a program that utilizes an Internet connection to provide real time sports bet odds and information for a plurality of sports games from a plurality of sport books, said real time sports bet odds and information being downloaded and stored on a user's computer, and wherein said program being incapable of placing bets;

the program displaying a major line move alert indicating when a number of sport books change their odds for a bet for a sports game in the same direction with a user settable period of time and a bet tracker that displays a list of the bets made by a user or a line seeker alert indicating when a sport book has odds that satisfy a set of criteria of the user;

navigating said display in order to acquire real time sports bet odds and information using a menu made up of various menus, and for any particular game or bet, the program being capable of visually cycling through odds for the plurality of sport books; and the program being able to download and store, on the user's computer, information about occurrences in connection with odds, analyzing said information and alerting the user when a predetermined occurrence takes place in connection with the odds.

2. The method of claim 1 wherein alerting the user when a predetermined occurrence takes place in connection with the odds further comprises providing an alert to be given when a predetermined odds, on a particular game, is offered by a sports book.

3. The method of claim 1 wherein alerting the user when a predetermined occurrence takes place in connection with the odds further comprises providing means for notifying the user when a predetermined amount of sports books' odds change within a predetermined amount of time.

4. The method of claim 1 wherein said program is written in the C++ programming language.

5. A method for providing sporting event odds and information, for sports books, in substantially real time where the sports books, gamblers and enthusiasts want real time odds and information on the sports books computer, the method comprising:

providing a program that utilizes an Internet connection to provide real time sports bet odds and information for a plurality of sports games from a plurality of sport books, said real time sports bet odds and information being downloaded and stored on a user's computer, and wherein said program being incapable of placing bets;

the program displaying real time odds and information including a major line move alert indicating when a number of sport books change their odds for a bet for a sports game in the same direction with a user settable period of time;

navigating said display in order to acquire real time sports bet odds and information using a menu made up of various menus, and for any particular game or bet, the program being capable of visually cycling through odds for the plurality of sport books; and the program being able to download and store, on the user's computer, information about the odds, analyzing the information and logging and tracking bets for a total of winnings and losses.

6. The method of claim 5 wherein logging and tracking bets for a total of winnings and losses further comprises:

a. allowing the user to enter said bet and bet amount; and, b. grading the bet in order to decide whether the bet was won or lost.

7. The method of claim 6 wherein said program calculates and logs winnings and losses.

8. The method of claim 5 wherein said program is written in the C++ programming language.

9. A method for providing sporting event odds and information, for sports books, in substantially real time where the sports books, gamblers and enthusiasts want real time odds and information on the sports books computer, the method comprising:

providing a program that utilizes an Internet connection to provide real time sports bet odds and information for a plurality of sports games from a plurality of sport books, said real time sports bet odds and information being downloaded and stored on a user's computer, and wherein said program being incapable of placing bets;

the program displaying real time odds and information including a major line move alert indicating when a number of sport books change their odds for a bet for a sports game in the same direction with a user settable period of time;

navigating said display in order to acquire real time sports bet odds and information using a menu made up of various menus, and for any particular game or bet, the program being capable of visually cycling through odds for the plurality of sport books; and the program being able to download and store, on the user's computer, information about the odds and allowing for the display of odds on the user's computer to be manipulated for a more efficient use of said program.

10. The method of claim 9 wherein said step of allowing for the display of odds to be manipulated provides horizontal and vertical scrolling bars.

11. The method of claim 9 wherein said step of allowing for the display of odds to be manipulated provides a feature that turns a page every five seconds.

12. The method of claim 9 wherein said step of allowing for the display of odds to be manipulated provides a color coded display.

13. The method of claim 9 wherein said program is written in the C++ programming language.

14. The method of claim 9 wherein said step of allowing for the display of odds to be manipulated provides customizable casino columns.

15. The method of claim 14 wherein said casino columns can be moved by a click and drag method.

16. The method of claim 14 wherein said casino columns can be resized to a custom setting.

17. The method of claim 14 wherein said casino columns can be highlighted.

18. The method of claim 14 wherein said casino columns can be abbreviated in order to allow more columns per page.

19. A system for providing sporting event odds and information, for sports books, in substantially real time where the sports books, gamblers and enthusiasts want real time odds and information on the sports books computer, the method comprising:

program that utilizes an Internet connection to provide real time sports bet odds and information for a plurality of sports games from a plurality of sport books, said real time sports bet odds and information being downloaded and stored on a user's computer, and wherein said program being incapable of placing bets;

means for a display of real time sports bet odds and information including a major line move alert indicating when a number of sport books change their odds for a bet for a sports game in the same direction with a user settable period of time;

means for navigating said display in order to acquire real time sports bet odds and information, said navigation means comprising a menu made up of various menus, and for any particular game or bet, the program being capable of visually cycling through odds for the plurality of sport books; and means for downloading and storing, on a user's computer, occurrences in connection with the odds analyzing the information and alerting a user when a predetermined occurrence takes place in connection with the odds.

20. The system of claim 19 wherein said means for an alert to be given when a predetermined occurrence takes place in connection with the odds further comprises providing an alert to be given when a predetermined odds, on a particular game, is offered by a sports book.

21. The system of claim 19 wherein said means for an alert to be given when a predetermined occurrence takes place in connection with the odds further comprises providing means for notifying the user when a predetermined amount of sports books' odds change within a predetermined amount of time.

22. The system of claim 19 wherein said program is written in the C++ programming language.

23. A method for providing sporting event odds and information, for sports books, in substantially real time where the sports books, gamblers and enthusiasts want real time odds and information on the sports books computer, the method comprising:

providing a program that utilizes an Internet connection to provide real time sports bet odds and information for a plurality of sports games from a plurality of sport books, said real time sports bet odds and information being downloaded and stored on a user's computer, and wherein said program being incapable of placing bets;

the program displaying real time odds and information including a major line move alert indicating when a number of sport books change their odds for a bet for a sports game in the same direction with a user settable period of time;

navigating said display in order to acquire real time sports bet odds and information using a menu made up of various menus, and for any particular game or bet, the program being capable of visually cycling through odds for the plurality of sport books; and customizing the program so that the program downloads and stores, on the user's computer, occurrences connected with odds offered by one or more sports book, processes said downloaded information, and alerts the user when a predetermined occurrence takes place in connection with the odds offered by one sports book or a predetermined number of sports books to enable the user to acquire the information he needs automatically.

24. The method of claim 23 wherein said display further comprises:

a. a menu made up of various buttons; and b. said buttons are equipped with pull down menus.

25. The method of claim 23 wherein said program is written in the C++ programming language.

* * * * *